US005304792A

United States Patent [19]

Verat et al.

[11] Patent Number: 5,304,792

[45] Date of Patent: Apr. 19, 1994

[54] X-RAY IMAGE INTENSIFIER TUBE CASING

[75] Inventors: Maurice Verat, Saint Martin le Vinoux; Serge Cozzi, Moirans, both of France

[73] Assignee: Thomson Tubes Electroniques, Velizy, France

[21] Appl. No.: 967,045

[22] Filed: Oct. 27, 1992

[30] Foreign Application Priority Data

Oct. 31, 1991 [FR] France ..... 91 13488

[51] Int. Cl.[5] ..... H01J 40/14

[52] U.S. Cl. ..... 250/214 VT; 250/370.09

[58] Field of Search ..... 250/214 VT, 515.1, 370.09, 250/370.11, 363.01, 363.02, 363.08; 313/523

[56] References Cited

U.S. PATENT DOCUMENTS 4,171,480 10/1979 Wulms .

5,177,350 1/1993 Beauvais et al. ..... 250/214 VT

FOREIGN PATENT DOCUMENTS 0023051 1/1981 European Pat. Off. .

9113456 9/1991 PCT Int'l Appl. .

OTHER PUBLICATIONS

Patent Abstracts of Japan vol. 13, No. 125(P-847) Mar. 28, 1989 & JP-A-63 293 500 (Mitsubishi Cable Ind. Ltd.) Nov. 30, 1988.

*Primary Examiner*—David C. Nelms

*Assistant Examiner*—K. Shami

*Attorney, Agent, or Firm*—Oblon, Spivak, McClelland, Maier & Neustadt

[57] ABSTRACT

In an X-ray image intensifier tube, a casing for the protection from x-radiation from the X-ray image intensifier tube. The casing according to the present invention comprises a jacket of a thermoplastic material charged with a powder of a material that absorbs the x-radiation and a shielding from outside magnetic fields. The shielding is in contact with the jacket. The screen that absorbs the x radiation thus is at least partially formed of the jacket.

23 Claims, 1 Drawing Sheet

FIG.1
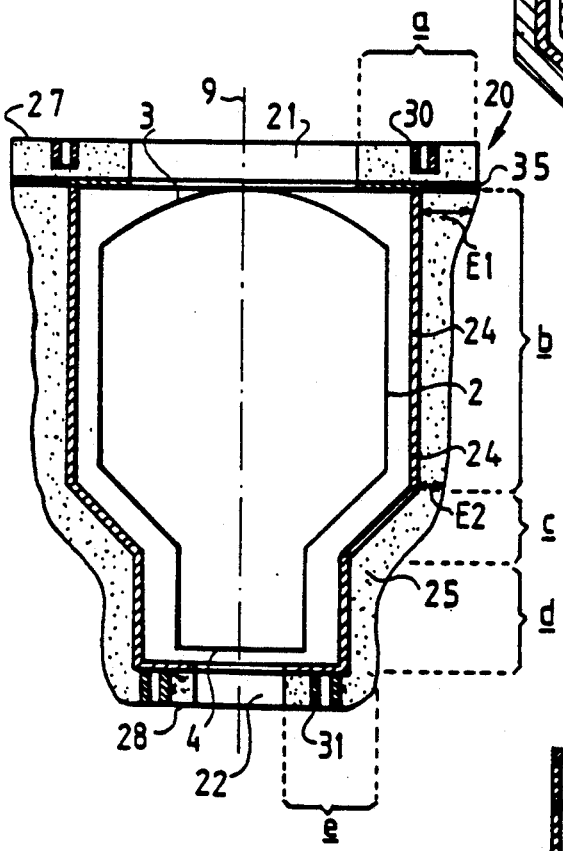
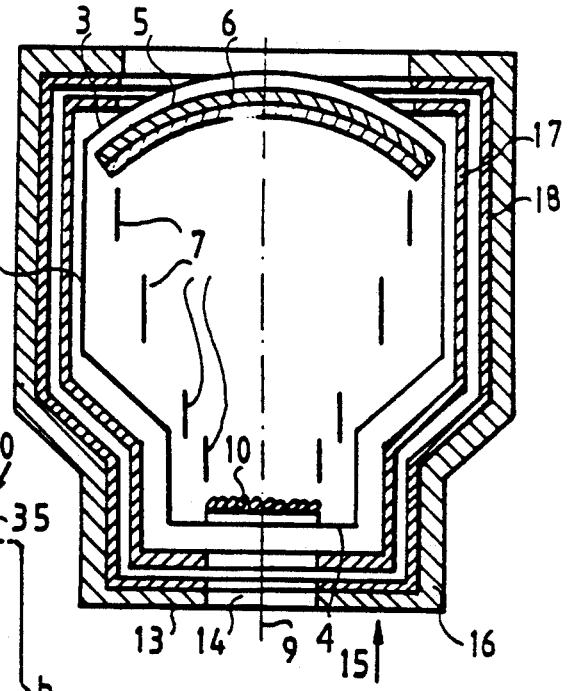
FIG.2
FIG.3
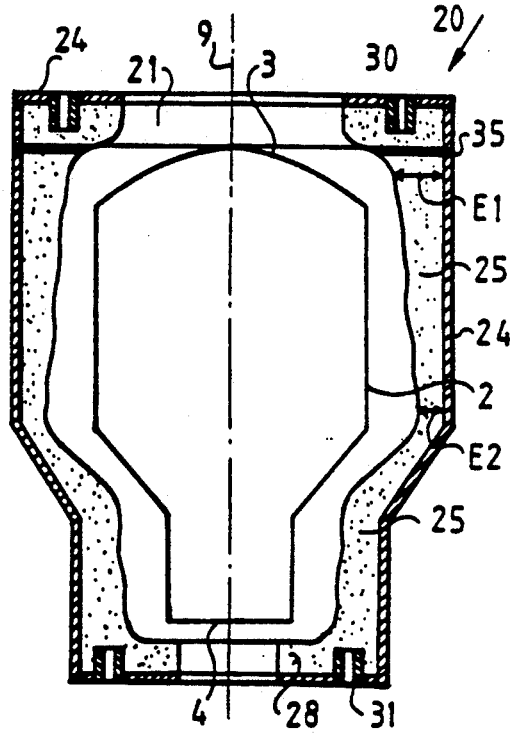

X-RAY IMAGE INTENSIFIER TUBE CASING

BACKGROUND OF THE INVENTION

1. Field of the Invention

The present invention relates to the casings for x-ray image intensifier tubes and, more particularly, to the means used in these casings to achieve protection from X-radiation.

2. Discussion of the Background

X-ray image intensifier tubes (in abbreviated form "XII tube" hereafter) are vacuum tubes comprising an input screen toward the front of the tube, an electron optical system, and a screen located at the back of the tube for observing a visible image.

FIG. 1 diagrammatically shows such an XII tube. The tube comprises a glass vacuum enclosure 2 having one end at the front of the tube which is closed by a input window 3 exposed to x-photon radiation.

The second end of enclosure 2 forming the back of the tube is closed by an output window 4 that is transparent to light.

Generated x-rays are converted into light rays by a scintillator screen 5. The light rays excite a photocathode 6 which in response emits electrons. These electrons are accelerated toward output window 4 using different electrodes 7 placed along a longitudinal axis 9 of the tube, and which form the electron optical system. In the example shown, output window 4 carries a cathodoluminescent screen 10, made of luminophores for example. The impact of the electrons on cathodoluminescent screen 10 makes it possible to restore an image formed at the beginning on photocathode 6.

The XII tube is contained in a protective enclosure casing 15, which in particular assures the following functions:

1) protection of electron optical system 7 and of the tube from spurious outside magnetic fields;

2) protection of persons from x-radiation, both direct x-radiation that is not absorbed by scintillator 5, and scattered x-radiation produced by the tube itself;

3) mechanical protection of vacuum enclosure 2 from the outside environment; and 4) to form the fastening interface with radiological equipment (not shown) on which the tube must be mounted, and with accessories for using this equipment, which may comprise, for example, threaded holes for the fastening at faces or planes of reference.

For this purpose, the wall of a standard casing 15 for an XII tube generally comprises several superposed layers 16, 17, 18.

The most outside layer 16 forms a jacket 16 which is the mechanical framework of casing 15. This jacket can be, for example: a cast of metal alloy; or else worked or stamped; or further, mechanical-welded, made from metal foils. Outside layer or jacket 16 assures the mechanical protection of the vacuum enclosure, and particularly in its back part 13, located toward output window 4 of the tube, it performs the fastening interface role. The image produced by cathodoluminescent screen 10 is visible outside the casing thanks to an opening 14 made in back part 13.

An inside layer 17, placed between outside layer 16 and enclosure 2 of the XII tube, constitutes a shielding that assures the protection of the electron optical system from outside magnetic fields. This inside or shielding layer 17 is made of a material exhibiting a high magnetic permeability, such as, for example, soft iron, or an iron-based alloy such as, for example, "permalloy" (iron-nickel alloy), or mu-metal, etc.

It should be noted that inside layer 17 that forms a shielding from the magnetic fields is made from foils of these materials having a high magnetic permeability.

A second inside layer 18, placed between enclosure 2 of the XII tube and the first inside layer 17, constitutes a screen whose function is to absorb the x-radiation. The object of this screen 18 is to attenuate the x-radiation which leaves casing 15.

The materials that are used to make this second inside layer 18 are also generally available in the form of foils, so that the making of this second layer or screen 18 (but also of first inside layer 17) relies on the techniques of boiler making: partial stamping, working, rolling, mechanical welding. These techniques result in long and costly operations which further result in high geometric tolerances.

To produce the second inside layer or screen 18, it is common to use materials having a high atomic number, and more particularly lead which exhibits the advantage of having a cost that is not very high and the ability for greatly absorbing the x-radiation.

However, lead is a material that is difficult to use because of its great malleability or ductility. Moreover, working with lea is regulated and the personnel who perform this work are subjected to constraints of medical observation.

Another point that poses a problem in the production of XII tube casings comes from the difficulty that there is in bonding the various layers 16, 17, 18 to one another.

These layers are often bonded by gluing, which constitutes an operation that is not very compatible with industrial requirements and which results, in particular, in high tolerances on the wall thicknesses.

The absorption of the x-radiation has as its goal to attenuate the x-radiation leaving the casing, up to a value compatible with determined regulations. Since the intensities of this incident x-radiation are not equal at all points of casing 15, the absorption of the radiation must not necessarily be equal at all these points, and it is enough to impart to the wall of the casing at these various points the appropriate coefficient of absorption to obtain the desired attenuation.

As shown in FIG. 2, it is possible to define in an XII tube casing several main zones *a, b, c, d, e*, which extend from the front 21 of the casing on the side of input window 3 up to the back 13 of the casing on the side of output window 4. Each of these zones can require an attenuation of the x-radiation that is different from that of an adjacent zone. For example, zone *b* where the tube is at its largest diameter requires overall to attenuate the x-radiation less than zone *c* where this diameter steadily decreases.

In each of zones *a* to *e*, the thickness of screen or layer 18 that absorbs the x-rays is calculated to reduce to the determined regulation value the highest level of incident x-rays existing in each zone.

But in the same zone, there can be considerable differences in the level of x-radiation, and the thickness of layer o screen 18 is selected for the attenuation of the x-radiation having the highest intensity.

Consequently, the quantity of material constituting screen 18 is superabundant in many of its points, which results in increases in weight and cost.

Thus, for example, it is common to impart to the various zones *a, b, c, d, e* of screen 18, if it consists of lead foils, thicknesses respectively of about 1.7 mm, 1.2 mm, 2.3 mm, 1.2 mm and 2.7 mm, whereas for zone *b*, for example, the greater part of this zone could have a thickness of only 0.6 mm.

SUMMARY OF THE INVENTION

The present invention has as its object to detail a novel XII tube casing whose design makes it possible to avoid the above-cited drawbacks.

The casing according to the present invention makes it possible to assure the various necessary protections, while exhibiting a lower weight than in the prior art, as well as a greater ease of production and therefore a lower cost.

According to the present invention, an x-ray image intensifier tube casing comprises a jacket, a screen for absorbing x-radiation, a shielding from outside magnetic fields, wherein the jacket is at least partially formed of a thermoplastic resin charged with a powder of a material that absorbs the x-radiation, so that the screen consists at least partially of the jacket.

By the expression "material that absorbs the x-radiation" we mean to define a material (used pure or alloyed or else a compound of this material) whose atomic number is high enough (for example, equal to or greater than 70) to assure a significant absorption of the x-radiation passing through it, such as lead or lead oxide, for example. Such materials are currently used for protection from x-rays, particularly in the field of radiology.

In addition to lead and lead oxide, there can be cited: Ta, Bi, W, etc., used pure or alloyed, or in the oxide state.

One of the advantages of such an arrangement is not only that it makes it possible to eliminate the layer made of foils of lead, or of another material having a high atomic number, but also that the jacket constitutes a particularly advantageous means to support and anchor the shielding.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1, already described, shows an XII tube casing according to the background art;

FIG. 2 shows diagrammatically an XII tube casing according to the present invention in a preferred embodiment;

FIG. 3 illustrates a variant embodiment of a casing according to the present invention.

DESCRIPTION OF THE PREFERRED EMBODIMENTS

Referring now to the drawings, wherein like reference numerals designate identical or corresponding parts throughout the several views, and more particularly to FIG. 2 thereof, there is shown a casing 20 according to the present invention, containing an image intensifier tube. Since this image intensifier tube is, for example, of a type similar to the one shown in FIG. 1, it is represented in FIG. 2 only by its enclosure 2. Casing 20 has a general shape similar to that of FIG. 1, i.e., it comprises a large opening 21, known as an input opening, located on the side of input window 3 of the tube, and an output opening 22 located on the side of output window 4.

According to the present invention, casing 20 comprises a wall 25 forming a jacket, made of a composite material making it possible for this wall to, at the same time, fulfill the function of a mechanical framework and of a screen for absorbing the x-radiation. For example, this composite material can consist of an injectable thermoplastic material charged with a material (in powder form) having a high atomic number to absorb the x-radiation in a significant way, as has already been explained in the introductory section.

The thermoplastic material or basic material can, for example, be: ABS (acrylonitrile-butadiene-styrene) such as, for example, the product called "RONFALIN" produced by DSM (a German company, producer of plastics); or else, further, high density polypropylene; these two products have been satisfactorily tested, but there are many others that can be used.

In regard to the material forming the charge, i.e., the material (in powder form) that absorbs the x-radiation, advantageous results have been obtained by using a lead oxide PbO, and more particularly a lead monoxide, the other lead oxides being less advantageous because their lead content is lower. Of course, other materials or other oxides of heavy metals can also be used to absorb the x-radiation as explained above, so long as these materials are in the form of powder to charge the basic material.

The above-cited lead oxide (lead monoxide) has been used in the present invention with a grain size less than 45 μm, to charge "RONFALIN" produced by DSM with a charge rate on the order of 35% by volume. The 35% charge rate can be considered as being approximately a maximum above which problems appear in injection molding technology.

It should be noted that the production of articles of PbO charged plastic is a process already used for articles of small dimensions for very young children. In this case, the charge rate is much lower and does not exceed 5%; in case of accidental ingestion, the presence of lead makes it possible for an easy location by radiography.

The material charged with the heavy material, intended to constitute wall 25 of casing 15, can be used by injection molding techniques that in themselves are standard. To produce a casing 20, an advantage of injection molding techniques is that they make it possible to obtain, in a relatively simple way, parts having complex geometric shapes. In addition, in the case of large series, the cost of the parts obtained by molding is low while exhibiting a good reproducibility of these parts, and the tolerances on the dimensions are lower than in the case of the casings produced according to the techniques of the prior art.

These advantages are to be considered in addition to the considerable simplification of the structure of casing 20, a simplification which resides in the fact that wall 25 at the same time assures the mechanical rigidity and the function of a screen for the absorption of the x-radiation.

Another significant advantage that producing wall 25 by molding brings is that it makes it possible to impart, at all points of this wall, thicknesses E1, E2, E3 only absolutely necessary for absorbing the x-radiation existing in each of these points, from which a reduction in bulk and weight as well as a savings of material results.

In the nonlimiting example shown in FIG. 2, it can be seen that the various zones *a, b, c, d, e* do not all have a constant thickness, to adapt it to what is absolutely necessary. For example, zone *b* has a greater thickness E1, on the order of 5 mm, toward the front 21 and a slighter thickness E2, on the order of 2.5 mm, toward the back 13.

It should be noted that to obtain an attenuation of the x-radiation (with the charged thermoplastic material) equivalent to that of lead, a length about 4 times larger than with lead is necessary. For example, it would be necessary to insert into zone *b* a thickness of lead of 1.2 mm to produce the attenuation that is obtained with the charged thermoplastic material having a thickness E1, i.e., 5 mm.

Casing 15 comprises a layer 24 made of a material having a high magnetic permeability forming a shielding 24 from outside magnetic fields, and surrounding enclosure 2 of the tube at least partially. In the example shown in FIG. 2, shielding 24 is placed against wall 25 on the inside of casing 20. Shielding 24 can be made from foils of a material having a high magnetic permeability, and these foils can be bonded to wall 25 by gluing, for example. But this can also be performed in a much simpler way, namely by inserting the foils of shielding 24 into the mold to constitute layer 24 before injecting the material that is used to constitute wall 25. The foils can cover the bottom of the mold, before the injection of material, and they ar made integral with wall 25 by the adherence of the material on layer 24 forming a shielding, during the cooling of this material. It is also possible according to a technique known in the art to provide anchoring elements (not shown) in shielding layer 24.

A casing 20 made according to the present invention makes it possible to use the technique of inserts. This technique comprises placing objects in the mold before injecting the material to be molded so as to bury them at least partially in this material and thus to make them mechanically integral with the solidified material. It is thus possible to make, for example, insert nuts 30, 31 (buried in wall 25) and/or studs (not shown), to assure the various fastenings.

In the example shown in FIG. 2, on the one hand, insert nuts 30 are placed in a front part 27 of casing 20 (located on the side of input opening 21) to make possible the fastening of tube 1 to equipment (not shown) with which it is to be associated. And, on the other hand, other insert screens 31 are placed on a bottom part 28 (in which output opening 22 is made), to make the fastening of accessories (not shown) possible.

It should be noted that shielding 24, in addition to its shielding function, reinforces the mechanical rigidity of wall 25, and in the case of particularly heavy loads to be secured, shielding 24 prevents having to impart to wall 25, locally, a thickness greater than that which is absolutely necessary to absorb the x-radiation.

Wall 25 of thermoplastic material, even charged, constitutes an electrical insulator that can locally store electric charges. This is especially true since very often output window 4 of the tube comprises metal parts brought too the potential of a high voltage power supply of the tube. Since shielding 24 is an electrically conductive surface, it can in this case be brought to a reference potential, the ground for example, so as to constitute an electrical screen between output window 4 and jacket 25 of casing 20.

For this purpose, it is enough, for example, to provide an electrical conductor wire (not shown) connected to shielding 24, or further to extend, for example, an insert nut 31 to bring it in contact with shielding 24.

Thickness variations E1, E2 of wall 25 occur from shielding 24, shielding 24 being on the inside of casing 20, in the example shown in FIG. 2.

FIG. 3 illustrates another embodiment which differs from the one shown in FIG. 2 in that shielding 24 is bonded to wall 25 on the outside of casing 20, thickness variations E1, E2 being reflected on the inside of casing 20.

One of the advantages of this arrangement of FIG. 3 is that it makes it possible to achieve a total protection of persons and equipment from electric currents and voltages, if the shielding is brought to the reference potential such as the ground.

In this embodiment of FIG. 3, shielding 24 can be made in the same way as in the case of the example of FIG. 2, from foils (not shown) of a metallic material of high magnetic permeability. These foils can in this case also be placed inserted in the mold, to be on the outside of wall 25, i.e., on the outside of casing 20. Nuts 30, 31 can be placed inserted as in the example of FIG. 2, by going through, for example, shielding 24.

Both in the example of FIG. 2 and in that of FIG. 3, front part 21 is shown added to wall 25. Actually, it is necessary to separate front part 21 that forms a cover from the body, i.e., from the rest of casing 20 to introduce the XII tube into the casing.

The connection of front part 21 to the body of the casing is represented in the form of a glue joint 35, but of course other means can be used for this purpose, such as for example screwing, snapping, etc.

Obviously, numerous additional modifications and variations of the present invention are possible in light of the above teachings. It is therefore to be understood that within the scope of the pending claims, the invention may be practiced otherwise than as specifically described herein.

What is claimed as new and desired to be secured by Letters Patent of the U.S. is:

1. An X-ray image intensifier tube casing comprising:
a jacket;
a screen for absorbing x-radiation generated in the x-ray image intensifier tube;
a shielding from outside magnetic fields;
wherein the jacket is at least partially made of a thermoplastic material charged with a powder of a material that absorbs x-radiation, so that said absorbing screen is comprised of at least partially of the jacket; and
means to electrically connect the shielding to an outside of the jacket.

2. The casing according to claim 1, wherein the shielding is placed on the inside of the jacket and is in contact with the jacket.

3. The casing according to claim 1, wherein the jacket exhibits thickness variations.

4. The casing according to claim 1, wherein the thermoplastic material is a material that can be injected into a mold.

5. The casing according to claim 4, wherein the thermoplastic material is charged with lead monoxide.

6. The casing according claim 1, wherein the shielding is bonded to the jacket so as to participate in mechanical rigidity of the jacket.

7. The casing according to claim 5, wherein the thermoplastic material is charged with lead monoxide at a charge rate on an order of 35% by volume.

8. A casing for an X-ray image intensifier tube comprising:

a shielding formed to surround portions of the X-ray image intensifier tube for insulation from outside magnetic fields;

a jacket to surround portions of the X-ray image intensifier tube, the jacket being at least partially made of a thermoplastic material charged with a powder of a material that absorbs x-radiation, generated in the X-ray image intensifier tube; and means to electrically connect the shielding to an outside of the jacket.

9. The casing according to claim 8, wherein the shielding is formed between the jacket and the X-ray image intensifier tube and contacts the jacket.

10. The casing according to claim 8, wherein the jacket exhibits thickness variations.

11. The casing according to claim 8, wherein the thermoplastic material is a material that can be injected into a mold.

12. The casing according to claim 11, wherein the thermoplastic material is charged with lead monoxide.

13. The casing according to claim 8, wherein the shielding is bonded to the jacket so as to provide mechanical rigidity to the jacket.

14. The casing according to claim 11, wherein the thermoplastic material is charged with lead monoxide at a charge rate on an order of 35% by volume.

15. A casing for an X-ray image intensifier tube which has an input window and an output window, and which narrows at a predetermined area from the input window to the output window comprising:

a shielding formed to surround portions of the X-ray image intensifier tube for insulation from outside magnetic fields;

a jacket to surround portions of the X-ray image intensifier tube, the jacket being at least partially made of a thermoplastic material charged with a powder of a material that absorbs x-radiation, generated in the X-ray image intensifier tube; and wherein the jacket has a variable predetermined thickness, said variable predetermined thickness in all points being adjusted for absorbing the x-radiation existing in said all points of the jacket.

16. The casing according to claim 15, wherein the shielding is formed between the jacket and the X-ray image intensifier tube and contacts the jacket.

17. The casing according to claim 15, further comprising means to electrically connect the shielding to an outside of the jacket.

18. The casing according to claim 15, wherein the shielding is formed on an outside of the jacket and contacts the jacket.

19. The casing according to claim 15, wherein the thermoplastic material is a material that can be injected into a mold.

20. The casing according to claim 19, wherein the thermoplastic material is charged with lead monoxide.

21. The casing according claim 15, wherein the shielding is bonded to the jacket so as to provide mechanical rigidity to the jacket.

22. The casing according to claim 19, wherein the thermoplastic material is charged with lead monoxide at a charge rate on an order of 35% by volume.

23. The casing according to claim 15, wherein the jacket is wider at the input window than at the predetermined area where the X-ray image intensifier tube narrows.

* * * * *